United States Patent [19]

Evans et al.

[11] 4,342,604

[45] Aug. 3, 1982

[54] PRODUCTION OF A STABLE LACTOSE PRODUCT

[75] Inventors: John W. Evans, Weed; Gary C. Young; Charles W. Stager, both of Visalia, all of Calif.

[73] Assignee: Nutrisearch Company, Cincinnati, Ohio

[21] Appl. No.: 194,722

[22] Filed: Oct. 7, 1980

Related U.S. Application Data

[63] Continuation-in-part of Ser. No. 128,426, Mar. 10, 1980, abandoned, which is a continuation-in-part of Ser. No. 96,366, Nov. 21, 1979, abandoned.

[51] Int. Cl.[3] ..... C13K 5/00

[52] U.S. Cl. ..... 127/31; 127/55; 127/58

[58] Field of Search ..... 127/31, 58

[56] References Cited

U.S. PATENT DOCUMENTS

| | | | |
|---|---|---|---|
| 2,467,453 | 4/1949 | Almy | 127/31 |
| 2,477,558 | 8/1949 | Almy | 127/31 |
| 3,785,865 | 1/1974 | Pollard | 127/31 X |

OTHER PUBLICATIONS

A. E. Martell et al., "Chemistry of the Metal Chelate Compounds", 490–495, Prentice–Hall, Englewood Cliffs, 1956.

Chemical Abstracts, 55: P23869, (1961).

*Primary Examiner*—Sidney Marantz

*Attorney, Agent, or Firm*—Cushman, Darby & Cushman

[57] ABSTRACT

Lactose having reproducible pH and a lowered ash level can be produced from lactose rich permeate resulting from the ultrafiltration of whey, by adding a small amount of a chelating agent such as a salt of ethylenediaminetetraacetic acid as, for instance, the disodium salt, the calcium disodium salt, or an alkali metal polyphosphate, as sodium hexametaphosphate to the lactose containing permeate prior to crystallization of the lactose.

16 Claims, No Drawings

PRODUCTION OF A STABLE LACTOSE PRODUCT

CROSS-REFERENCE TO RELATED APPLICATION

This application is a continuation-in-part of U.S. application Ser. No. 128,426, filed Mar. 10, 1980 now abandoned, which is a continuation-in-part of U.S. application Ser. No. 96,366, filed Nov. 21, 1979, now abandoned.

BACKGROUND OF THE INVENTION

1. Field of the Invention

The invention relates to a process for preparing lactose with a lowered reproducible, stable pH and a lower ash level.

2. Prior Art

Lactose or milk sugar is obtained by crystallization from a milk derived source, such as cheese whey. Whey, the byproduct of cheese manufacture, is available in about 3.5 billion gallons per year. Numerous attempts have been made to extract the valuable protein and lactose components from the whey. In one method, whey protein is concentrated by passing the whey through an ultrafiltration membrane. The protein retentate is dried and the lactose and ash rich permeate is further treated to remove the lactose therefrom. Lactose prepared by crystallization from permeate varies in pH from 6.4 to 7.7, and the ash content is generally in excess of 0.12% by weight depending on the level in raw batch material (milk). Impurities in the lactose magma after crystallization, centrifugation and packaging influence the final product pH. Consistency in the maintenance of the lactose pH at not greater than 7.44, but preferably 7.0 or less is essential to customers due to the current requirements for lactose pH imposed by the United States government and other countries.

It has now been found that the pH and the ash content of lactose, produced by various membrane process techniques and particularly the ultrafiltration of whey, can be controlled in accordance with the present invention.

SUMMARY OF THE INVENTION

It has been discovered that addition of an effective amount of a chelating agent such as an alkali metal polyphosphate, as, for instance sodium or potassium tripolyphosphate, or sodium potassium or ammonium metaphosphate, preferably sodium hexametaphosphate (hereinafter SHMP) or mixtures thereof, or a salt of ethylenediaminetetraacetic acid (hereinafter EDTA), such as the disodium, calcium disodium, tetrasodium, diammonium or tetraammonium salts, or mixtures thereof or other such related food grade chelating agents as the pentasodium salt of diethylenetriaminepentaacetic acid, and the trisodium salt of N-(hydroxyethyl)-(EDTA), to the permeate derived from membrane separation of whey, prior to the crystallization of the lactose therefrom, produces lactose having a reproducible stable pH of less than 7.44 and preferably 7.0 or less, and a lowered ash content.

It is understood that the invention is directed to food grade chelating agents.

DESCRIPTION OF THE INVENTION

Permeate derived or prepared from sweet whey or acid whey, i.e., chedar, cottage, cream, Swiss or mozzarella wheys can be used in the practice of this invention. Permeate is the byproduct resulting from passing whey through a semi-permeable membrane, as for instance, an ultrafiltration membrane.

A representative method for ultrafiltration is disclosed in Horton, B. S. et al., Food Technology, Vol. 26, No. 2, p. 30, 1972.

In a typical process, acid whey is neutralized to a pH of from 6.4 to 7.0 with 50% caustic. After storage, the pH is adjusted to about 7.2 and any solids or precipitates can be removed by centrifugal clarifiers. The clarified liquor is then pasteurized. The pasteurized liquor is then fed into an ultrafiltration membrane unit. Membranes having molecular weight cut-offs equal to or less than 20,000 can be used. If a membrane having a 20,000 molecular weight cut-off is used, the permeate solids generally comprises from about 4% to about 6% protein (based on total Kjeldahl nitrogen); from about 10% to about 15% ash, normally 11%; substantially no fat and the remainder comprising lactose.

The permeate can be delactosed at this stage by any normal lactose crystallization technique.

The preferred permeate product used in the present invention is the permeate resulting from the ultrafiltration of whey. The permeate generally has a concentration of solids between 5% and 12% and preferably about 8.5% after ultrafiltration. The solution then can be concentrated using normal concentration techniques such as evaporators, to form a solution containing from about 34% to about 42% and preferably about 40% dissolved solids. This concentrated permeate solution can be further concentrated at an elevated temperature to provide a solution of lactose, containing from about 58% to about 70% total dissolved solids, preferably about 63%. This solution at approximately 70° C. (or from about 55° C. to about 80° C.) is conveyed to crystallizers where the lactose crystallizes out as the temperature is reduced to from 13°–24° C. After sufficient holding time (about 10 to 20 hours), the lactose is separated from the liquid by conventional means such as filters, contrifuges, basket centrifuges and the like. The lactose can be dried directly, washed and dried, or redissolved and recrystallized to further improve purity, as is normally accomplished with activated charcoal and bone char. The liquid separated from the lactose is termed "delactosed permeate" which solids content generally comprises from about 8% to about 12% protein (based on total Kjeldahl nitrogen), and from about 25% to about 35% ash, substantially no fat and the remainder comprising lactose.

In accordance with the present invention, a food grade chelating agent such as an alkali metal polyphosphate as for instance SHMP or an EDTA salt such as disodium EDTA or calcium disodium is added to the permeate at any time prior to crystallization to control and stabilize the pH of the lactose product and lower its ash content. In the practice of this invention, the chelating agent, the EDTA salt, or the alkali metal salt, preferably is added to the permeate prior to crystallization. It is most conveniently added to the partially concentrated permeate solution having a total solids content of 33–40% or prior to evaporation when the permeate has a 5–12% total solids content.

The chelating agent can be conveniently added to the permeate in the form of an aqueous solution. The EDTA salt for instance can be dissolved in water to form an aqueous solution having from 0.5 to 39 wt. % of the EDTA salt and preferably 10 to 29 wt. %. The solution can be metered into the permeate solution in amounts sufficient to desirably provide from about $2.5\times10^{-5}$ to about $1\times10^{-2}$ and more desirably about $2\times10^{-4}$ to $5\times10^{-3}$ grams EDTA salt per gram of permeate solids in the solution. The EDTA salt of which the disodium salt is the preferred composition is preferably used in an amount ranging from about $4\times10^{-4}$ to $4\times10^{-3}$ grams of EDTA salt per gram of permeate solids. The EDTA salt, however, is effective when added in amounts equal to or greater than $2.5\times10^{-5}$ gram per gram permeate solids. It should be understood that the effective amounts of the EDTA salt will vary within the broad range disclosed depending on the level of impurities contained in the permeate.

In accordance with the present invention, alkali metal polyphosphates such as sodium, potassium or ammonium pyrophosphate, sodium or potassium tripolyphosphate or sodium, potassium or ammonium metaphosphate having average chain lengths of about 2-24 and preferably about 10 to 12, is added to the permeate at any time prior to crystallization to control and stabilize the pH of the lactose product and lower its ash content. In the practice of this invention, the polyphosphate, preferably SHMP is added to the permeate prior to crystallization. It is most conveniently added to the partially concentrated permeate solution having a total solids content of 33-40% or prior to evaporation when the permeate has a 5-12% total solids content.

The alkali metal polyphosphate can also be conveniently added to the permeate in the form of an aqueous solution. The polyphosphate can be dissolved in water to form an aqueous solution having from 10-40 wt. % of the polyphosphate and preferably 15 to 25 wt. %. The solution can be metered into the permeate solution in amounts sufficient to desirably provide from about $2.5\times10^{-5}$ to about $1\times10^{-2}$ and more desirably about $2\times10^{-4}$ to $5\times10^{-4}$ grams polyphosphate per gram of permeate solids in the solution. The alkali metal polyphosphate of which SHMP is the preferred composition is preferably used in an amount ranging from about $2.6\times10^{-4}$ to $4.5\times10^{-4}$ grams of polyphosphate per gram of permeate solids. The polyphosphate, however, is effective when added in amounts equal to or greater than $2.5\times10^{-5}$ grams per gram permeate solids.

The addition of food grade chelating agents such as disclosed herein to the permeate is accomplished with sufficient agitation so that it can be uniformly distributed throughout the concentrate. The use of the small amount of the chelating agent as disclosed provides lactose which has been reduced in ash content. One series of tests showed a reduction in ash from 0.12% by weight to 0.10% by weight. The reduction in the ash content of the lactose product as well as the ability to control pH result in a higher quality product.

EXAMPLE I

Lactose samples were prepared from the permeate obtained by the ultrafiltration of acid whey using the process disclosed herein. SHMP was added as noted in the table below to the permeate after concentration of the permeate to 60% total solids at an elevated temperature of 71° C. (160° F.). The lactose was crystallized by reducing the temperature of the concentrated permeate to 18° C. (65° F.) for 15-20 hours. The lactose was separated by centrifuge and dried. Solutions of the lactose samples were prepared (10%) and tested with a pH meter. The following results were obtained:

| Sample | Grams SHMP/Gram Permeate Solid | pH |
|---|---|---|
| 1 | — | 7.7 |
| 2 | $7.69\times10^{-5}$ | 7.2 |
| 3 | $1.28\times10^{-4}$ | 7.1 |
| 4 | $2.56\times10^{-4}$ | 7.0 |
| 5 | $9.74\times10^{-4}$ | 6.8 |

EXAMPLE 2

Permeate from acid whey was concentrated by evaporation to 30-40% total solids at 49° C. (120° F.) and then further concentrated by evaporation to about 60% total solids at 71° C. (160° F.). The lactose was crystallized by cooling to 18° C. (65° F.) and holding for 15-20 hours. The lactose monohydrate crystals were recovered by basket centrifugation and dried in a rotary dryer with an exhaust air temperature at from 83°-93° C. (180°-200° F.).

The lactose product prepared in the above manner was produced over a period of four months. SHMP was added to some products as detailed below when the permeate was concentrated to from 32-40% total solids. The pH of a 10% solution prepared from the lactose samples was obtained.

Results were as follows:

| Month | Gms. SHMP/Gm. Permeate Solids | Average Product pH of Lactose | No. of Lots Above pH of 7.44 |
|---|---|---|---|
| 1 | — | 6.95 | 38 |
| 2 | — | 7.14 | 14 |
| 3 | $3.0\times10^{-4}$ | 6.66 | 0 |
| 4 | $3.0\times10^{-4}$ | 6.37 | 0 |

EXAMPLE 3

Permeate from acid whey was concentrated by evaporation to 30-40% total solids at 40° C. (120° F.) and further concentrated by evaporation to 60% total solids at 71° C. (160° F.). The lactose was crystallized by cooling to 18° C. (65° F.) and holding for 15-20 hours. The lactose monohydrate crystals were recovered by basket centrifugation and dried in a rotary dryer with exhaust air temperature at from 83°-93° C. (180°-200° F.).

The lactose product prepared in the above manner was produced over a four month period. SHMP was added as detailed below when the permeate was concentrated to from 32-40% solids.

Results obtained were as follows:

| Month | Average Ash Content Wt. % In Lactose | SHMP added gms/gm. Permeate Solids |
|---|---|---|
| 1 | 0.15 | — |
| 2 | 0.19 | — |
| 3 | 0.10 | $3.0\times10^{-4}$ |
| 4 | 0.09 | $3.0\times10^{-4}$ |

SHMP, therefore, when added to the permeate prior to crystallization had the effect of lowering the ash content of the lactose product produced therefrom.

EXAMPLE 4

Lactose samples were prepared from the permeate obtained by the ultrafiltration of acid whey using the process disclosed herein. The disodium salt of EDTA ($C_{10}H_{14}N_2Na_2O_8.2H_2O$) was added to the permeate after concentration of the permeate to 60% total solids at an elevated temperature of 71° C. (160° F.) as shown below. The lactose was crystallized by reducing the temperature of the concentrated permeate to 18° C. (65° F.) for 15–20 hours. The lactose was separated by centrifuge and dried. Solutions of the lactose samples were prepared (10%) and tested with a pH meter. The following results were obtained.

| Sample | Grams EDTA Salt/Gram Permeate Solid | pH |
|---|---|---|
| 1 | NONE | Greater than 7.0 |
| 2 | $4.2 \times 10^{-3}$ | Less than 7.0 |

EXAMPLE 5

Permeate from acid whey was concentrated by evaporation to 30–40% total solids at 49° C. (120° F.) and then further concentrated by evaporation to about 60% total solids at 71° C. (160° F.). The lactose was crystallized by cooling to 18° C. (65° F.) and holding for 15–20 hours. The lactose monohydrate crystals were recovered by basket centrifugation and dried with an exhaust air temperature at from 83°–93° C. (180°–200° F.).

EDTA (disodium salt) was added to one sample as detailed below when the permeate was concentrated to from 32–40% total solids. The pH of a 10% solution prepared from the lactose samples was obtained.

| Sample | (Grams EDTA Salt/ Gram Permeate Solids) | pH |
|---|---|---|
| 1 | None | 6.71 |
| 2 | $3.3 \times 10^{-3}$ | 6.14 |

EXAMPLE 6

Permeate from acid whey was concentrated by evaporation to 30–40% total solids at 49° C. (120° F.) The lactose was crystallized by cooling to 18° C. (65° F.) and holding for 15–20 hours. Samples of the lactose monohydrate crystals were recovered by basket centrifugation and dried with air at a temperature at from 83°–93° C. (180°–200° F.).

The tetrasodium salt of EDTA was added as detailed below when the permeate was concentrated to from 30–40% solids.

Results obtained were as follows:

| Sample | Average Ash Content Wt. % In Lactose | EDTA Salt Added Gms/Gm. Permeate Solids |
|---|---|---|
| 1 | 0.20 | — |

-continued

| Sample | Average Ash Content Wt. % In Lactose | EDTA Salt Added Gms/Gm. Permeate Solids |
|---|---|---|
| 2 | 0.15 | — |
| 3 | 0.07 | $4 \times 10^{-3}$ |

The chelating agent when added to the permeate prior to crystallization had the effect of lowering the ash content of the lactose product produced therefrom.

What is claimed is:

1. A method of producing a crystallized lactose product comprising adding a food grade chelating agent to a lactose-containing permeate resulting from the ultrafiltration of whey, the amount of chelating agent added resulting in a product having a pH of not greater than 7.44 and having a lowered ash content.

2. The crystallized lactose product made in accordance with the method of claim 1.

3. The method of claim 1 wherein the chelating agent is an alkali metal polyphosphate.

4. The crystallized lactose product made in accordance with the method of claim 3.

5. The lactose product of claim 4 wherein the polyphosphate is sodium hexametaphosphate.

6. The method of claim 3 wherein the alkali metal polyphosphate is sodium hexametaphosphate.

7. The method of claim 3 or 6 wherein polyphosphate is added in an amount of from about $2.5 \times 10^{-5}$ to about $1 \times 10^{-2}$ grams per gram of permeate solids.

8. The method of claim 6 wherein sodium hexametaphosphate is added in an amount ranging from about $2 \times 10^{-4}$ to about $5 \times 10^{-4}$ grams per gram of permeate solids.

9. The method of claim 6 wherein the sodium hexametaphosphate is added in an amount ranging from about $2.6 \times 10^{-4}$ to about $4.5 \times 10^{-4}$ grams per gram of permeate solids.

10. The method of claim 1 wherein the chelating agent is a salt of ethylenediaminetetraacetic acid.

11. The method of claim 10 wherein the salt of ethylenediaminetetraacetic acid is added in an amount ranging from about $4 \times 10^{-4}$ to about $4 \times 10^{-3}$ grams per gram of permeate solids.

12. The crystallized lactose product made in accordance with the method of claim 10.

13. The lactose product of claim 12 wherein the salt of ethylenediaminetetraacetate acid is disodium ethylenediaminetetraacetic acid.

14. The method of claim 10 wherein the salt of ethylenediaminetetraacetic acid is the disodium salt.

15. The method of claim 10 or 14 wherein the salt of ethylenediaminetetraacetic acid is added in an amount of from about $2.5 \times 10^{-5}$ to about $1 \times 10^{-2}$ grams per gram of permeate solids.

16. The method of claim 10 or 14 wherein the salt of ethylenediaminetetraacetic acid is added in an amount ranging from about $2 \times 10^{-4}$ to about $5 \times 10^{-3}$ grams per gram of permeate solids.

* * * * *